US005144971A

United States Patent [19]

Seidel et al.

[11] Patent Number: 5,144,971

[45] Date of Patent: Sep. 8, 1992

[54] SHORTENABLE UMBRELLA

[75] Inventors: Joachim Seidel, Solingen; Klaus Stiller, Langenfeld, both of Fed. Rep. of Germany

[73] Assignee: Kortenbach Verwaltungs-und Beteiligungsgesellschaft MBH & Co., Solingen, Fed. Rep. of Germany

[21] Appl. No.: 594,029

[22] Filed: Oct. 9, 1990

[30] Foreign Application Priority Data

Feb. 13, 1990 [DE] Fed. Rep. of Germany .... 4004349.5

[51] Int. Cl.[5] ..... A01G 17/00

[52] U.S. Cl. ..... 135/22; 135/25.3

[58] Field of Search ..... 135/32, 25.3, 25.1

[56] References Cited

U.S. PATENT DOCUMENTS 4,077,421 3/1978 Schultes ..... 135/25.3

4,658,844 4/1987 Ping ..... 135/25.3

*Primary Examiner*—Henry E. Raduazo

*Attorney, Agent, or Firm*—Samuel Meerkreebs

[57] ABSTRACT

A shortenable umbrella has a frame with three part canopy-supporting rods (D1, D2, D3) which are respectively associated with two interacting parallelogram linkage (P1, P2). A corner of one linkage (P1) is provided by a pin and slot (**9,9*a*) of which the pin passes through a diagonal (Di) of the linkage to a stable over centre position, maintained by radial tension in a canopy cover (18), when the umbrella is opened. The over centre effect is automatically released by spreading of struts (3**) at the beginning of closing of the umbrella.

11 Claims, 2 Drawing Sheets

SHORTENABLE UMBRELLA

BACKGROUND OF THE INVENTION

FIELD OF THE INVENTION

The invention generally relates to self-opening, collapsible, foldable and shortenable umbrellas.

The invention relates to a shortenable umbrella of a kind, comprising canopy rods which radiate from a stick and which are shortenable in at least a threefold manner. The stick being telescopic in at least two stages; a canopy cover supported by the canopy rods; a slider which is displaceable along the stick; struts pivotally connected at one end to the slider and at the other end at a first joint to a respective inner canopy rod part which, at its inner end, is pivotally connected to a ring fixed on the stick and, at its outer end is pivotally connected via a second joint to a respective control link. The control link having a lever arm extending inwardly of the second joint and connected at a third joint to an outer end of a respective control rod which is connected at its inner end at a fourth joint to a respective strut. Outer canopy rod parts each engaging an outer end of a respective control link at a fifth joint; and central canopy rod parts each consisting of inner and outer portions which are each pivotally connected at their adjacent ends to a respective slide element slidable along a respective one of the control links. The inner portion engaging the respective inner canopy rod part at a sixth joint inwardly of the second joint, and the outer portion engaging the inner end of a respective outer canopy rod part at a joint on a lever arm of the outer canopy rod part which extends inwardly of the fifth joint; whereby each control link and the respective central canopy rod part form the longer links. The part of the respective inner canopy rod part between the second and sixth joints and the lever arm of the respective outer canopy rod part form the shorter links, of a first parallelogram linkage which interacts with a second parallelogram linkage formed by that portion of the respective inner canopy rod part outwardly of the first joint and the respective control rod as longer links, and by a lever arm of the respective strut between the first and fourth joints and the lever arm of the respective control link as the shorter links.

An umbrella of this type is known, for example, from Federal Republic of Germany, Patent DE 3,809,873 A1. This construction has a relatively stable structure and a large protective canopy area with a small volume in the shortened, collapsed state. However, it is difficult to achieve a maximum stretching of the canopy rods with a corresponding maximum protective canopy parabola and unimpeded opening and closing operation. The canopy stretching is in practice therefore either not fully utilizable or it is achieved at the expense of user-friendly operation and careful maintenance of the umbrella.

SUMMARY OF THE INVENTION

The primary object of the invention is to be able to open an umbrella of this construction to a maximum expanse along with as large as possible stretching of the canopy rods and protective canopy area and to be able to close this umbrella smoothly and in an unimpeded manner in particular from this maximum opening and stretched condition.

This object is achieved by the invention in that, in an umbrella of the kind described, the canopy rod parts are securely spread open by an over centre catch resulting from each third joint incorporating a pin and slot so arranged that the respective control rod can move its effective connection point with the respective control link up through a line joining the respective second and fourth joints to a stable over centre position which is maintained by radial tension in the canopy cover; and in that, when closing the canopy by drawing the slider down the stick, each catch is released by the fact that the outer end of the strut initially moves outwards, thereby displacing the respective control rod outwardly, and in turn displacing the effective connection point at the third joint within the slot down through the respective line joining the second and fourth joints and hence out of the over centre position.

It is thus guaranteed that the canopy linkage in the spread state can be transposed into the position of greatest possible stretching. This results in a canopy parabola which has maximum collapsibility, covers a large surface area and is thus optimally utilizable. In this case, the canopy rods rest closely adjacently or even rest on top of one another to be stabilized in a resistant, compact formation. The above dead-centre position results from the upward overtilting of the connection joint towards the inner canopy rod, exceeding the connection diagonal slightly. When closing the umbrella, this above dead-centre position would normally lead to the parts of the rods in this region being completely blocked under the spreading pressure of the canopy cover pulling towards the centre with the result that the closing of the canopy would only be possible with the application of force and at the risk of breaking the parts. This is likewise avoided. The above dead-centre catch then acts as an antilock device. To do so, it makes use of the release movement of the canopy cover briefly occurring in the first instant when closing the canopy. In this instant, in the course of the onsetting closing spread, the strut moves the control rod with the connection joint, even before the actual folding movement of the canopy begins, tilting down again beyond the connection diagonal. Here, the control rod with the connection joint again assumes a lever-effective engagement position relative to the control link with the result that the then following folding of the canopy takes place smoothly.

A particularly advantageous application of the structure according to the invention, i.e. resulting from the particular smoothness of the canopy kinematics, is in a self- opening umbrella. An appropriate automatic opening mechanism may have a compression spring drive, which spring is interposed between an abutment fixed relatively to the stick, and a crown, which is displaceable axially above the ring and which is pivotally connected to the inner canopy rod parts by upper struts.

The abutment may be formed by the ring.

Alternatively, the spring can be supported directly on the stick, and, by this means, the circumferential volume of the closed umbrella can be reduced in that the abutment is a stop located on or in the stick.

A further reduction of the circumferential volume of closed umbrella can result if the lower end of the spring is received into the stick.

The crown may have a spigot of which is guided displaceably in the upper end of the stick. The upper end of the spring may be received within a cavity in the crown. In that case, the upper end of the stick guiding the spigot may project beyond the ring but, in the closed state of the umbrella, is also received in the cavity in the crown.

The ring may be provided with a casing for the lower end of the spring, the casing being anchored on the stick by means of a shaping of the stick engaging the casing.

An umbrella frame with an opening mechanism of this kind forms the subject of our copending application of even date, reference 50/4268/01.

The invention is explained in greater detail below with reference to an exemplary embodiment illustrated in the drawing, in which:

DESCRIPTION OF A PREFERRED EMBODIMENT

Figures 1, 2:
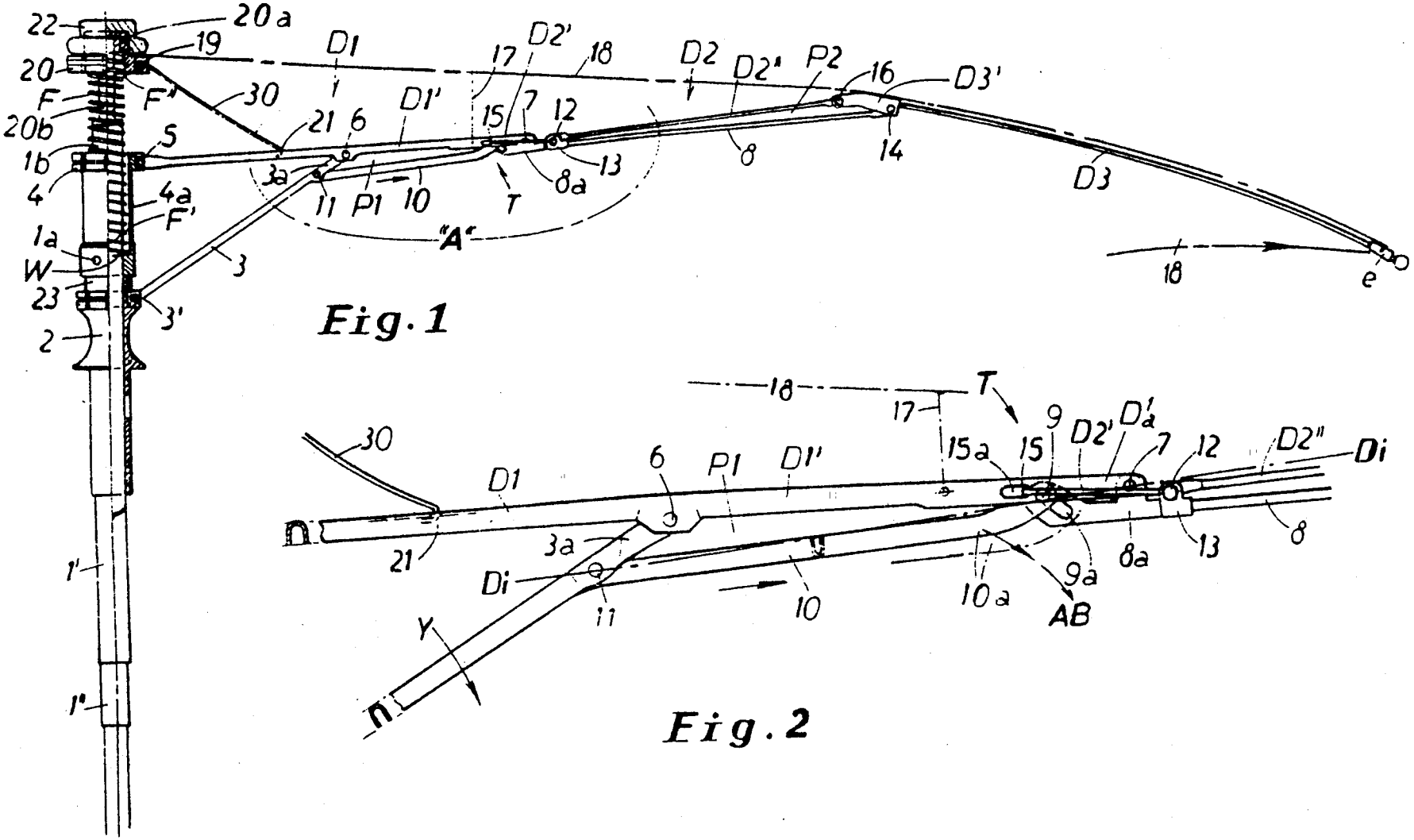
FIG. 1 shows in elevation half of a self opening umbrella constructed according to the invention with opened canopy.
FIG. 2 is an enlarged view of the portion "A" in FIG. 1.

The invention can be put into effect irrespective of whether the canopy rods consist of three or four hinged and/or telescopic members and, accordingly, foldable and/or slidable constructions. In the case of the exemplary embodiment illustrated, the invention is used in conjunction with a shortenable umbrella frame which can be folded in a threefold manner. The frame has canopy rods each consisting of inner, central and outer parts D1, D2 and D3, respectively, which can be folded onto one another and, extend from a central fixing ring 4, to the peripheral ends e of the canopy rod parts D3. A stick 1 can have at least two telescopic parts 1' and 1" on which a main slider 2 is displaceable upwards and downwards. The latter serves for retracting the open umbrella canopy when it is pulled down along the stick 1. Pivoted at joints 3' on the main slider 2 are lower struts 3 which, via pivot joints 6, support the inner canopy rod parts D1 from below. These rod parts D1 are hinged to the central fixing ring 4 at pivot joints 5.

For the purposes of clear representation, the drawings only show one of the canopy rod formations which extend radially and are arranged around an umbrella crown 20.

At its outer end, each inner canopy rod D1 is connected via a pivot joint 7 to a short lever arm 8*a* of a control link 8 for the respective central canopy rod part D2. The short lever arm 8*a* is connected to a control rod 10 by a pivot joint 9. The joint 9 has a pin which is guided displaceably in a slot 9*a* in such a way that the lever arm 8*a* and an end 10*a* of the control rod 10 can enter a U shaped profile of the canopy rod part D1 when the umbrella canopy is opened and can contact the base of this profile; see the projections at left-hand end of FIG. 2; the pin of the joint 9 situated in the end 10*a* coming to rest above the connection diagonal Di and, consequently, in an above dead centre position in relation to both the pivot joint 7 and a pivot joint 11 between the rod 10 and the strut 3. In this position enforced by the tension in a canopy cover 18, any leverage of the control rod 10 on the short lever arm 8*a* in the closing direction of the canopy is eliminated and thus, also, the canopy is held in its optimally stable flat open position shown in FIGS. 1 and 2 under the tension in the canopy cover 18.

However, the pin/slot connection 9, 9*a* also has the effect of an anti-lock device AB. It releases an over centre catch T, described above, as soon as the initial phase of the closing of the canopy begins upon pulling down of the main slider 2. At this time, the lower strut 3 is spread in the direction of the arrow Y and the control rod 10 is displaced radially outwards so that the joint pin 9 in the slot 9*a* of the lever arm 8*a* is inevitably also jerked downwards through of the dead centre position described above to a position below the connection diagonal Di, as shown by the arrow AB in FIG. 2. Accordingly, at the same time as the release of the canopy cover 18, the held open position of the umbrella canopy is already released and the required lever engagement on the short lever arm 8*a* in relation to the joint 7 is reestablished so that, when the main slider 2 is pulled down further, the entire subsequent closing movement of the canopy can take place smoothly.

Figure 5:
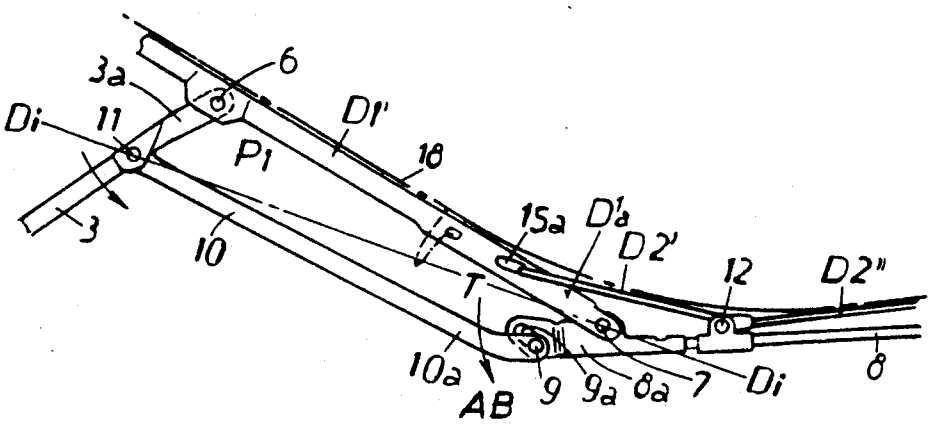

A portion D1' of the inner canopy rod part D1 and the control rod 10 form the long links, and the short lever arm 8*a* with a portion 3*a* of the strut 3 located between the joints 6 and 11 form the short links, of a first parallelogram linkage P1; see FIG. 5.

Each central canopy rod part D2, extending approximately parallel to the respective control link 8, consists of two portions D2' and D2". These are pivotally interconnected by a joint 12 and guided displaceably by means of a slide element 13 on the control link 8; see FIGS. 1 and 2. At its outer end, the control link 8 is pivotally connected by a joint 14 to the respective outer canopy rod part D3. The part D2' is pivotally connected by a joint 15 to the respective inner canopy rod part D1 while the portion D2" engages a short lever arm D3' of the outer canopy rod part D3 via a pivotal joint 16. Accordingly, the central canopy rod part D2 with its two portion D2' and D2", together with the control link 8, form the long links, and the short lever arm D3' of the outer canopy rod part D3 with the short lever arm D1*a* between the joints 7 and 15 form the short links of a second parallelogram linkage P2. The joint 15 can be combined with a guide slot 15*a*, in which the part D2' is displaceable in the form of a hairpin for the purpose of achieving a length compensation during the changing of part positions according to FIGS. 3 and 1.

The central fixing ring 4 is connected to the stick 1, fixed in terms of rotation and displacement, by means of a transverse pin or a shaping la embossed out of the stick 1 in the form of a tab or a nipple. The structure described above can be opened and collapsed entirely without restraint and can thus be operated very smoothly. It is therefore well suited for use with a self-acting mechanism for the opening of the canopy. For this purpose, the fixing ring 4 can be provided with a spring housing 4*a* shown partly in section in FIGS. 1 and 3, and can provide a lower abutment W for the lower end F' of a drive spring F. The spring is supported with its upper end F" inside a cavity 20*a* of the crown 20 and is consequently stressed (compressed) and released or relaxed between the abutment W, fixed to the stick, and the crown 20 and serves as a motor for opening the umbrella canopy. The crown 20 can be guided displaceably by means of a spigot 20*b* extending into the stick 1, or it can be supported over an end 1*b* of the stick non positively without such a guide simply by the drive spring F and held freely suspended over the end 1*b* of the stick by the radial arrangement of upper struts 30 about the crown. The upper struts 30 are hooked rotatably on to the crown 20 and in the respective inner canopy rod parts D1 and, consequently, connected by pivotal joints 19 and 21. In this manner, the crown 20 upon opening and closing of the canopy is raised and lowered in relation to the stick 1 and the fixing ring 4 and, correspondingly, the drive spring F is also released and relaxed per (FIG. 1) and stressed (FIG. 3).

The drive spring F can also be sunk into the stick 1 and can contact an abutment W', fixed to the stick, with its lower end F' on a transverse pin or tab 1*c* or an annular groove of the stick 1. The end 1*b* of the stick can protrude beyond the fixing ring 4 in the form of a projection and, together with the upper end F' of the drive spring F, can be completely received in the cavity 20*a* of the crown 20 in the closed position of the umbrella canopy.

Figure 4:
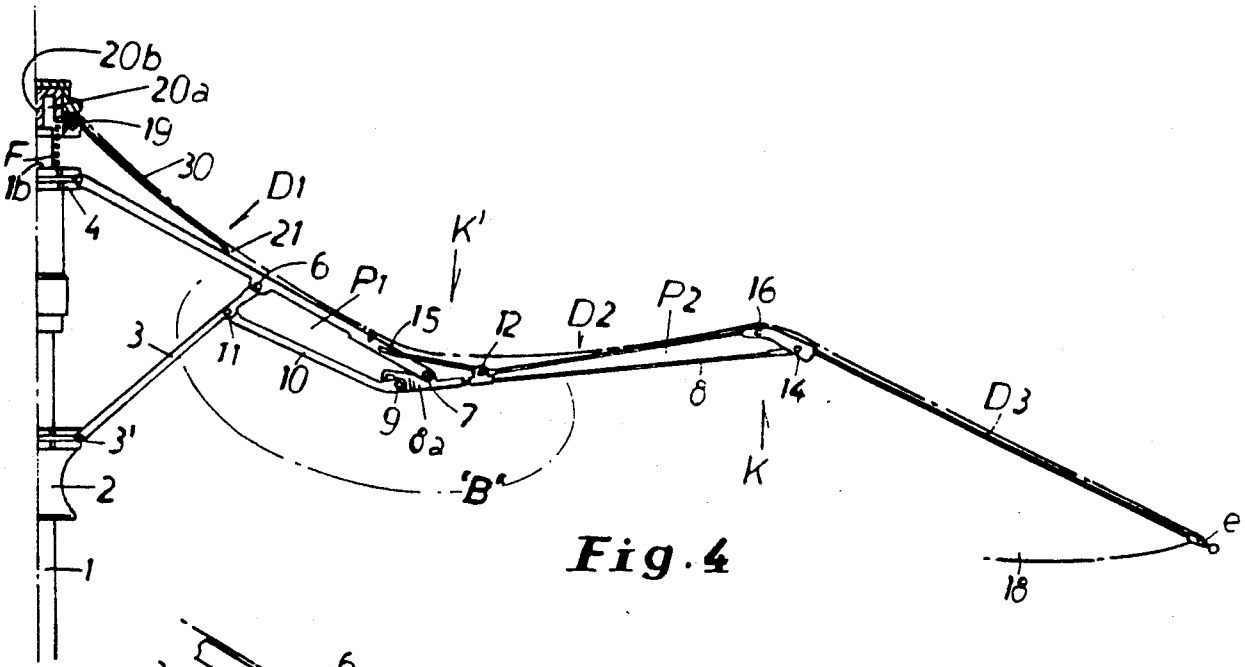
FIG. 4 shows the half umbrella of FIG. 3 in a half opened condition of the umbrella canopy; and, FIG. 5 is an enlarged view of the portion "B" in FIG. 4.

The canopy is opened automatically with displacement of the main slider 2 on the stick 1 into the opened position according to FIG. 1 after releasing the slider 2 by means of a triggering device not shown but which is known per se. The canopy can be collapsed by pulling down the slider 2 by hand into the closed position according to FIG. 3. During collapsing; as seen in FIG. 4, the canopy rod parts D1 and D2 form a bend K' and, at the same time, the canopy cover 18; which is connected to the canopy rod part D1 by means of a thread 17; see FIG. 1, is also pulled in and folded. The outer canopy rod parts D3 collapse at a bend K against the canopy rod parts D2 during the closing so that, in folded position, they point with their ends e down towards an umbrella handle (not shown) at the bottom of the stick 1.

Figure 3:
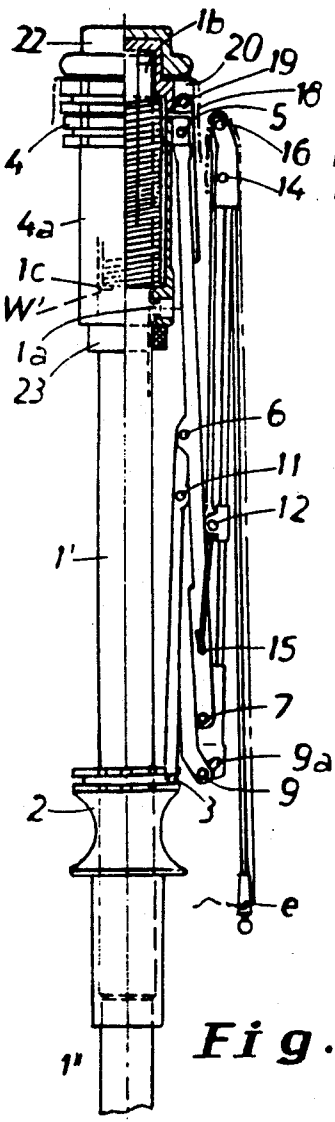
FIG. 3 shows the half umbrella according to FIG. 1, but in the closed or folded state of the umbrella canopy.

The U shaped profiling, already described, of the canopy rod parts D1 and D2, of the struts 3 and of the control rods 10 can be effected in such a way that these parts enter completely or at least predominantly inside one another in the closed state of the umbrella canopy according to FIG. 3 and, in this manner, in conjunction with the encapsulated structure of the opening mechanism at the tip of the umbrella result in a bundle of small and compact volume. The canopy cover 18 is fixed to the crown 20 by means of a cap 22. An annular shock absorber 23, arranged under the central fixing ring 4, absorbs the stop-energy of the main slider 2 on the fixing ring 4 when moving to the opened position of the canopy.

We claim:

1. A shortenable umbrella comprising canopy rods which radiate from a stick and which are shortenable in at least a three-fold manner, the stick being telescopic in at least two stages, a canopy cover supported by the canopy rods, a slider displaceably-supported on the stick; struts pivotally connected at at one end to the slider and at an outer end at a first joint to a respective canopy rod part which, at an inner end is pivotally connected by a second joint to a ring fixed on the stick and, at its outer end is pivotally connected by a third joint to a respective control link, the control link having a lever arm extending inwardly of the third joint and connected at a fourth joint to an outer end of a respective control rod which is connected at an inner end at a fifth joint to a respective strut; outer canopy rod parts each engaging an outer end of a respective control link at a sixth joint; and a central canopy rod parts each consisting of inner and outer portions which are pivotally connected at their adjacent ends to a respective slide element slidable along a respective one of the control links, said inner portion engaging a respective inner canopy rod part at a seventh joint inwardly of the third joint and an outer portion engaging an inner end of a respective outer canopy part at a joint on a lever arm of the outer canopy rod part which extends inwardly of the sixth joint; each control link and the respective central canopy part forming longer links, and a part of the respective inner canopy rod part between the third and seventh joints and the lever arm of the respective outer canopy rod part forming shorter links of a first parallelogram linkage which interacts with a second parallelogram linkage formed by a portion of a respective inner canopy part outwardly of the first joint and the respective control rod as longer links, and by a lever arm of the respective strut between the first and fifth joints and a lever arm of the respective control link as shorter links; the canopy rod parts being secured spread open by an over center catch comprising each fourth joint and including a pin an d slot so arranged so that the respective control rod moves effective connection point, with the respective control link, up through a line joining the respective third and fifth joints to a stable over center position maintained by radial tension in the canopy cover; and in that, when closing the canopy, by drawing the slider down the stick, each over center catch is released by the outer end of the strut initially moving outwards, thereby displacing a connection point at the fourth joint, within the slot, outwards and downthrough the respective line joining the third and fifth joint, and beyond the over center position.

2. An umbrella according to claim 1, including an automatic opening mechanism having a drive compression spring, which is interposed between an abutment fixed relatively to the stick, and a crown, which is displaceable axially above the ring and which is pivotally connected to the inner canopy rod parts by upper struts.

3. An umbrella according to claim 2, in which the abutment comprises a ring.

4. An umbrella according to claim 2, in which the abutment comprises a stop located on the stick.

5. An umbrella according to claim 4, in which the lower end of the spring is received within the stick.

6. An umbrella according to claim 2, in which the crown has a spigot which is displaceably guided in an upper end of the stick.

7. An umbrella according to any one of claims 2 to 6, in which the upper end of the spring is received within a cavity of the crown.

8. An umbrella according to either one of claims 6 and 7, in which the upper end of the stick guiding the spigot projects beyond the ring, and in the closed state of the umbrella, is received within the cavity in the crown.

9. An umbrella according to any one of the preceding claims 2 to 8, in which the ring is provided with a casing for the lower end of the spring, the casing anchored on the stick by means of a shaped portion of the stick engaging the casing.

10. An umbrella according to claim 2 in which the abutment is a stop located in the stick.

11. An umbrella according to claim 10, in which the lower end of the spring is received within the stick.

* * * * *